US011313104B2

(12) United States Patent
Ahn

(10) Patent No.: US 11,313,104 B2
(45) Date of Patent: Apr. 26, 2022

(54) CONTROL SYSTEM FOR CONSTRUCTION MACHINERY

(71) Applicant: DOOSAN INFRACORE CO., LTD., Incheon (KR)

(72) Inventor: Hyeonsik Ahn, Seoul (KR)

(73) Assignee: DOOSAN INFRACORE CO., LTD, Incheon (KR)

( * ) Notice: Subject to any disclaimer, the term of this patent is extended or adjusted under 35 U.S.C. 154(b) by 0 days.

(21) Appl. No.: 17/282,075

(22) PCT Filed: Sep. 27, 2019

(86) PCT No.: PCT/KR2019/012585

§ 371 (c)(1),
(2) Date: Apr. 1, 2021

(87) PCT Pub. No.: WO2020/071690

PCT Pub. Date: Apr. 9, 2020

(65) Prior Publication Data

US 2021/0324608 A1 Oct. 21, 2021

(30) Foreign Application Priority Data

Oct. 1, 2018 (KR) ..... 10-2018-0116713

(51) Int. Cl.
*F15B 11/05* (2006.01)
*E02F 9/22* (2006.01)
*F15B 13/02* (2006.01)

(52) U.S. Cl.
CPC ..... *E02F 9/2225* (2013.01); *E02F 9/2267* (2013.01); *F15B 11/05* (2013.01); *F15B 13/026* (2013.01); *F15B 2211/40569* (2013.01)

(58) Field of Classification Search
CPC ..... F15B 11/05; F15B 13/026; F15B 2211/40569; E02F 9/2225; E02F 9/2267
See application file for complete search history.

(56) References Cited

U.S. PATENT DOCUMENTS 6,644,169 B2 * 11/2003 Deininger ..... B66F 9/22 137/596.17
7,302,797 B2 * 12/2007 Zhang ..... E02F 9/2225 60/422
2003/0115878 A1 6/2003 Joung

FOREIGN PATENT DOCUMENTS

JP 06-159306 A 6/1994
JP 07-305379 A 11/1995
(Continued)

OTHER PUBLICATIONS

International Search Report dated Jan. 7, 2020, corresponding to International Application No. PCT/KR2019/012585.

*Primary Examiner* — Thomas E Lazo
(74) *Attorney, Agent, or Firm* — Hauptman Ham, LLP

(57) ABSTRACT

A control system for construction machinery includes a hydraulic cylinder operable by a working oil discharged from a hydraulic pump, a control valve arranged between the hydraulic pump and the hydraulic cylinder to control an operation of the hydraulic cylinder according to a position of a spool therein, the control valve having a first spool position for draining the working oil discharged from a chamber of the hydraulic cylinder to a drain tank, and a pressure compensated valve installed in a return hydraulic line through which the working oil discharged from the control valve at the first spool position is drained to the drain tank, the pressure compensated valve being configured to control a flow rate of the working oil passing through the pressure compensated valve according to a pressure difference between a front end and a rear end of the control valve.

8 Claims, 4 Drawing Sheets

(56) References Cited

FOREIGN PATENT DOCUMENTS

| | | | |
|---|---|---|---|
| JP | 2008-202704 | A | 9/2008 |
| KR | 10-1995-0002378 | B1 | 3/1995 |

* cited by examiner

CONTROL SYSTEM FOR CONSTRUCTION MACHINERY

CROSS-REFERENCE TO RELATED APPLICATION

This present application is a national stage filing under 35 U.S.C § 371 of PCT application number PCT/KR2019/012585 filed on Sep. 27, 2019, which is based upon and claims the benefit of priority to Korean Patent Application No. 10-2018-0116713 filed Oct. 1, 2018 in the Korean Intellectual Property Office. The disclosures of the above-listed applications are hereby incorporated by reference herein in their entireties.

TECHNICAL FIELD

The present invention relates to a control system for construction machinery. More particularly, the present invention relates to a control system for construction machinery for controlling a hydraulic cylinder of an excavator.

BACKGROUND ART

In an excavator having an arm cylinder, a regeneration cut valve may be used to regenerate a hydraulic oil, which is returned from a rod side chamber of the arm cylinder to a drain tank, to a head side chamber of the arm cylinder during an arm crowd operation. However, when such a regenerative cut valve is applied, it may be very difficult to tune an area diagram of the arm control spool, and there is a problem in that processing costs for applying the regenerative cut valve to the arm control valve are high.

DISCLOSURE OF THE INVENTION

Problems to be Solved

An object of the present invention provides a control system for construction machinery capable of facilitating speed control during an arm crowd operation at low cost.

Means to Solve the Problems

According to example embodiments, a control system for construction machinery includes a hydraulic cylinder operable by a working oil discharged from a hydraulic pump, a control valve arranged between the hydraulic pump and the hydraulic cylinder to control an operation of the hydraulic cylinder according to a position of a spool therein, the control valve having a first spool position for draining the working oil discharged from a chamber of the hydraulic cylinder to a drain tank, and a pressure compensated valve installed in a return hydraulic line through which the working oil discharged from the control valve at the first spool position is drained to the drain tank, the pressure compensated valve being configured to control a flow rate of the working oil passing through the pressure compensated valve according to a pressure difference between a front end and a rear end of the control valve.

In example embodiments, an opening amount of the pressure compensated valve may be controlled according to a pressure difference between a first pilot pressure supplied through a first pilot line branched off from a rod hydraulic line connected to the chamber and a second pilot pressure supplied through a second pilot line branched off from the return hydraulic line in front of the pressure compensated valve.

In example embodiments, the chamber may be a rod side chamber of the hydraulic chamber.

In example embodiments, the hydraulic cylinder may include an arm cylinder.

In example embodiments, a valve body of the pressure compensated valve may be formed in a valve body of the control valve or in another valve body separate from the valve body of the control valve.

In example embodiments, the pressure compensated valve may include a compensation spring that is connected to a compensation spool and is configured to compensate the pressure difference between the front end and the rear end of the control valve by a spring force.

In example embodiments, the working oil may be drained to the drain tank through a return passage, a tank passage and a tank port that are selectively in communication with each other by a valve spool of the control valve, and the return passage, the tank passage and the tank port may constitute at least a portion of the return hydraulic line. An inlet of the pressure compensated valve may be in communication with a second pilot line that is in communication with the return passage and an outlet of the pressure compensated valve may be in communication with the tank passage.

According to example embodiments, a control system for construction machinery includes a hydraulic cylinder operable by a working oil discharged from a hydraulic pump, a control valve arranged between the hydraulic pump and the hydraulic cylinder to control an operation of the hydraulic cylinder according to a position of a spool therein, the control valve having a first spool position for draining the working oil discharged from a rod side chamber of the hydraulic cylinder to a drain tank, and a pressure compensated valve installed in a return hydraulic line through which the working oil discharged from the control valve at the first spool position is drained to the drain tank, the pressure compensated valve being configured to control a flow rate of the working oil passing through the pressure compensated valve according to a pressure difference between a front end and a rear end of the control valve. An opening amount of the pressure compensated valve is controlled according to a pressure difference between a first pilot pressure supplied through a first pilot line branched off from a rod hydraulic line connected to the rod side chamber and a second pilot pressure supplied through a second pilot line branched off from the return hydraulic line in front of the pressure compensated valve. The pressure compensated valve includes a compensation spring that is connected to a compensation spool and is configured to compensate the pressure difference between the front end and the rear end of the control valve by a spring force. The working oil is drained to the drain tank through a return passage, a tank passage and a tank port that are selectively in communication with each other by a valve spool of the control valve, and the return passage, the tank passage and the tank port constitute at least a portion of the return hydraulic line. An inlet of the pressure compensated valve is in communication with a second pilot line that is in communication with the return passage and an outlet of the pressure compensated valve is in communication with the tank passage.

Effects of the Invention

According to example embodiments, a control system for construction machinery may include a pressure compensated valve configured to control a flow rate of a working oil returned to a drain tank through an arm control valve according to a pressure difference between a front end and a rear end of the arm control valve. The pressure compensated valve may perform a meter-out speed control so as to provide an appropriate back pressure under a load condition as well as a no load condition during an arm crowd operation, to thereby reduce pressure loss and back pressure and save energy.

Therefore, it may be possible to very easily solve a difficult tuning problem, which is a problem caused by an application of an existing regenerative cut valve, to thereby achieve a desired arm crowd control performance. Moreover, even if there is a change in weight of a bucket (load loading, heavy bucket, etc.), there is an advantage that tuning of an area diagram of an arm control spool becomes unnecessary.

However, the effect of the invention may not be limited thereto, and may be expanded without being deviated from the concept and the scope of the present invention.

BEST MODE FOR CARRYING OUT THE INVENTION

Figure 1:
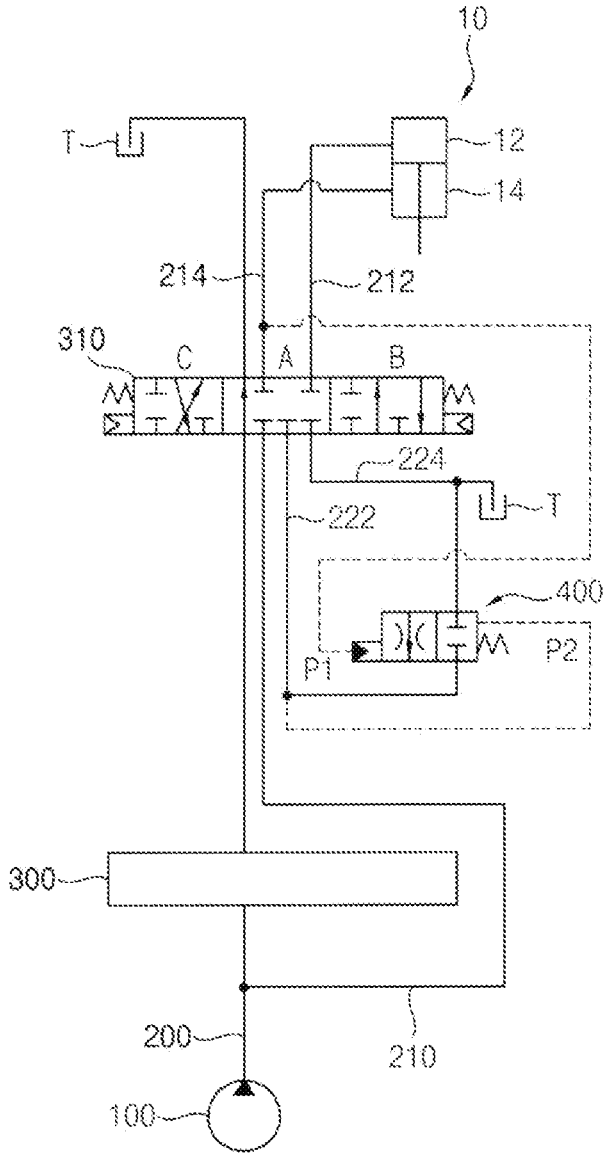
FIG. 1 is a hydraulic circuit diagram illustrating a control system for construction machinery in accordance with example embodiments.

Hereinafter, preferable embodiments of the present invention will be explained in detail with reference to the accompanying drawings.

In the drawings, the sizes and relative sizes of components or elements may be exaggerated for clarity.

It will be understood that, although the terms first, second, third, etc. may be used herein to describe various elements, components, regions, layers and/or sections, these elements, components, regions, layers and/or sections should not be limited by these terms. These terms are only used to distinguish one element, component, region, layer or section from another element, component, region, layer or section. Thus, a first element, component, region, layer or section discussed below could be termed a second element, component, region, layer or section without departing from the teachings of example embodiments.

The terminology used herein is for the purpose of describing particular example embodiments only and is not intended to be limiting of example embodiments. As used herein, the singular forms "a," "an" and "the" are intended to include the plural forms as well, unless the context clearly indicates otherwise. It will be further understood that the terms "comprises" and/or "comprising," when used in this specification, specify the presence of stated features, integers, steps, operations, elements, and/or components, but do not preclude the presence or addition of one or more other features, integers, steps, operations, elements, components, and/or groups thereof.

Unless otherwise defined, all terms (including technical and scientific terms) used herein have the same meaning as commonly understood by one of ordinary skill in the art to which example embodiments belong. It will be further understood that terms, such as those defined in commonly used dictionaries, should be interpreted as having a meaning that is consistent with their meaning in the context of the relevant art and will not be interpreted in an idealized or overly formal sense unless expressly so defined herein.

Example embodiments may, however, be embodied in many different forms and should not be construed as limited to example embodiments set forth herein. Rather, these example embodiments are provided so that this disclosure will be thorough and complete, and will fully convey the scope of example embodiments to those skilled in the art.

Figure 2:
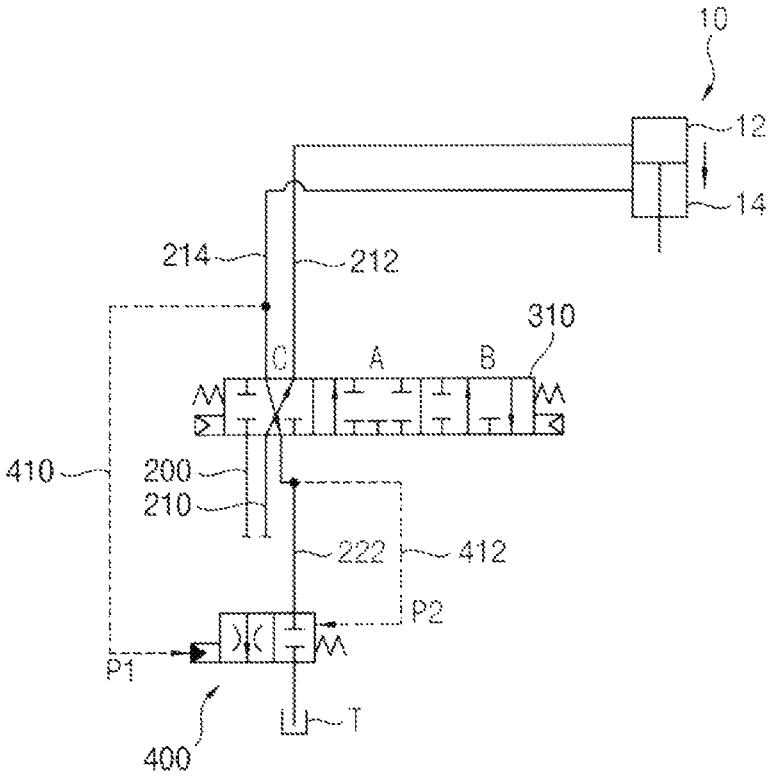
FIG. 2 is a hydraulic block diagram illustrating a portion of the control system for construction machinery in FIG. 1.
Figure 3:
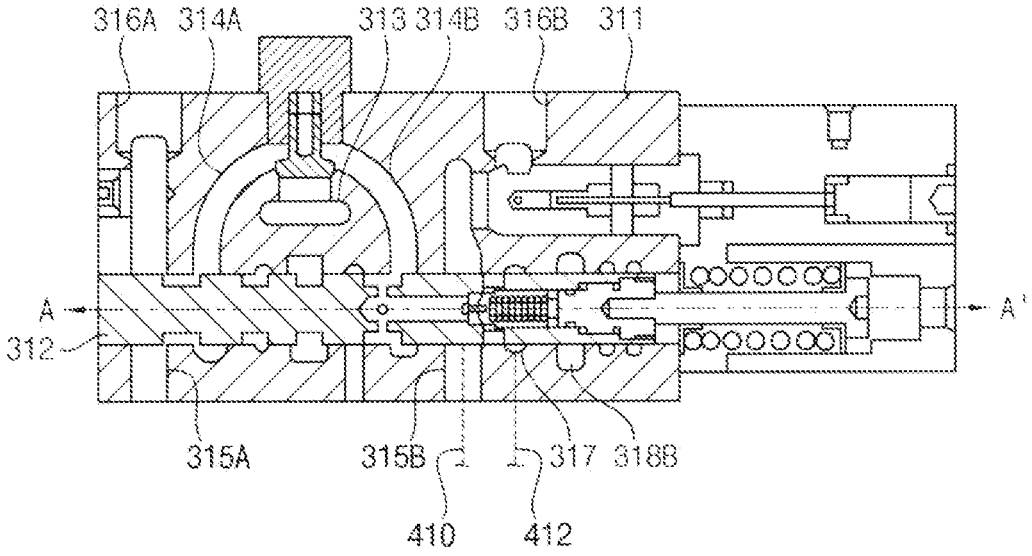
FIG. 3 is a cross-sectional view illustrating a control valve of a control system for construction machinery in accordance with example embodiments.
Figure 4:
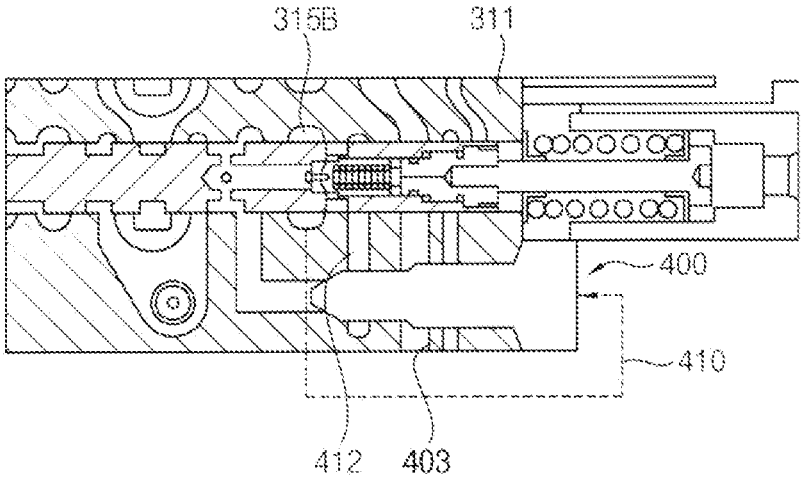
FIG. 4 is a cross-sectional view taken along the line A-A' in FIG. 3.
Figure 5:
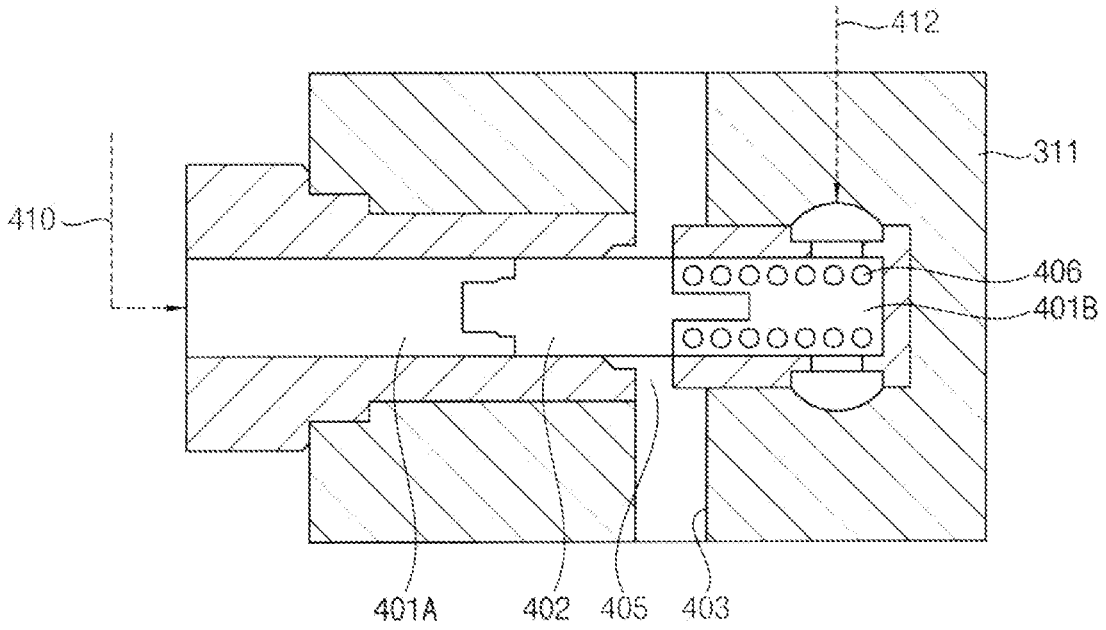
FIG. 5 is a cross-sectional view illustrating a pressure compression valve in FIG. 4.

FIG. 1 is a hydraulic circuit diagram illustrating a control system for construction machinery in accordance with example embodiments. FIG. 2 is a hydraulic block diagram illustrating a portion of the control system for construction machinery in FIG. 1. FIG. 3 is a cross-sectional view illustrating a control valve of a control system for construction machinery in accordance with example embodiments. FIG. 4 is a cross-sectional view taken along the line A-A' in FIG. 3. FIG. 5 is a cross-sectional view illustrating a pressure compression valve in FIG. 4.

Referring to FIGS. 1 to 5, a control system for construction machinery may include a hydraulic cylinder 10 operable as an actuator by a working oil discharged from a hydraulic pump 100, a control valve 310 arranged between the hydraulic pump 100 and the hydraulic cylinder 10 to control an operation of the hydraulic cylinder 10, and a pressure compensated valve 400 configured to control a flow rate of the working oil returned to a drain tank T through the control valve 310 according to a pressure difference between a front end and a rear end of the control valve 310.

In example embodiments, the construction machinery may include an excavator, a wheel loader, a forklift, etc. Hereinafter, it will be explained that example embodiments may be applied to the excavator. However, it may not be limited thereto, and it may be understood that example embodiments may be applied to other construction machinery such as the wheel loader, the forklift, etc.

The construction machinery may include a lower travelling body, an upper swinging body mounted to be capable of swinging on the lower travelling body, and a cabin and a front working device installed in the upper swinging body. The front working device may include a boom, an arm and a bucket. A boom cylinder for controlling a movement of the boom may be installed between the boom and the upper swinging body. An arm cylinder for controlling a movement of the arm may be installed between the arm and the boom. A bucket cylinder for controlling a movement of the bucket may be installed between the bucket and the arm. As the boom cylinder, the arm cylinder and the bucket cylinder expand or contract, the boom, the arm and the bucket may implement various movements, to thereby perform various works.

In example embodiments, the hydraulic pump 100 may be connected to an engine (not illustrated) or an electric motor (not illustrated) through a power transmission device. A power of the engine or the electric motor may be transmitted to the hydraulic pump 100. The working oil discharged from the hydraulic pump 100 may be distributed and supplied to the actuators through first and second control valves 300, 310, respectively.

In particular, the control system for the construction machinery may include a first circuit system which is connected to the hydraulic pump 100 and to which the working oil is supplied from the hydraulic pump 100. Additionally, although it is not illustrated in the figures, the control system for construction machinery may further include a second circuit system to which a working oil is supplied from another second hydraulic pump.

The first circuit system may include the first and second control valves 300, 310 sequentially connected to a main hydraulic line 200 that is connected to the hydraulic pump 100. The second control valve 310 may be connected to a parallel line 210 branching off from the main hydraulic line 200.

The working oil discharged from the hydraulic pump 100 may be distributed and supplied to the actuators through the first and second control valves 300, 310. For example, the second control valve 310 may control the operation of the arm cylinder 10. The working oil discharged from the hydraulic pump 100 may be supplied to the arm cylinder 10 through the parallel line 210 and the second control valve 310.

The second control valve 310, that is, the arm control valve, may be connected to arm head side chamber 12 and an arm rod side chamber 14 of the arm cylinder 10 through an arm head hydraulic line 212 and an arm rod hydraulic line 214 respectively. Accordingly, the second control valve 310 may be switched to selectively supply the working oil discharged from the hydraulic pump 100 to the arm head side chamber 12 and the arm rod side chamber 14.

The working oil driving the arm cylinder 10 may be returned to the drain tank T through first and second return hydraulic lines 222, 224. For example, the working oil from the arm rod side chamber 14 may be drained to the drain tank T through the second control valve 310, that is, through the first return hydraulic line 222 via the arm control valve. The working oil from the arm head side chamber 12 may be drained to the drain tank T through the second return hydraulic line 224 via the second control valve 310.

The second control valve 310 may be switched to a first position (A), a second position (B) and a third position (C) according to a displacement of a control spool 312 that is movable by a pilot pressure.

In the first position (neutral position (A)), the main hydraulic line 200 is connected to the drain tank (T), and the remaining hydraulic lines may be blocked. Accordingly, the working oil may not be supplied to the arm head side chamber 12 and the arm rod side chamber 14 of the arm cylinder 10, and the arm may be maintained at an initial position.

In the second position B, the parallel line 210 may be connected to the arm rod hydraulic line 214 and the arm head hydraulic line 212 may be connected to the second return hydraulic line 224. At this time, the main hydraulic line 200 may be completely blocked or partially blocked. Accordingly, the working oil discharged from the hydraulic pump 200 may be supplied to the arm rod side chamber 14 through the parallel line 210 and the arm rod hydraulic line 214, and the working oil in the arm head side chamber 12 may be drained to the drain tank T through the head hydraulic line 212 and the second return hydraulic line 224.

As illustrated in FIG. 2, in the third position C, the parallel line 210 may be connected to the arm head hydraulic line 212 and the arm rod hydraulic line 214 may be connected to the first return hydraulic line 222. At this time, the main hydraulic line 200 may be completely blocked or partially blocked. Accordingly, the working oil discharged from the hydraulic pump 200 may be supplied to the arm head side chamber 12 through the parallel line 210 and the arm head hydraulic line 212, and the working oil in the arm rod side chamber 14 may be drained to the drain tank T through the arm rod hydraulic line 214 and the first return hydraulic line 222.

In example embodiments, the pressure compensated valve 400 may be installed in the first return hydraulic line 222, and the flow rate of the working oil passing through the pressure compensated valve 400 may be controlled the pressure difference between the front end and the rear end of the second control valve 310.

In particular, the pressure compensated valve 400 may include a first pressure receiving portion 401A that receives a first pilot pressure supplied through a first pilot line 410 branched off from the arm rod hydraulic line 214 and a second pressure receiving portion 401B that receives a second pilot pressure supplied through a second pilot line 412 branched off from the first return hydraulic line 222 in front of the pressure compensated valve 400. An opening amount of the pressure compensated valve 400 may be controlled such that a difference between the first pilot pressure and the second pilot pressure becomes a constant value.

Referring to FIGS. 3 to 5, the pressure compensated valve 400 may be formed in a valve body 311 of the second control valve 310. Alternatively, the pressure compensated valve 400 may be formed in another valve body separate from the valve body 311 of the second control valve 310.

In the third position (C) of the second control valve 310, the working oil discharged from the hydraulic pump 100 may be introduced into a supply port 313 of the second control valve 310 through the parallel line 210, and be supplied to the arm head side chamber 12 of the arm cylinder 10 through the arm head hydraulic line 212 via a first branch passage 314A, a first load passage 315A and a first load port 316A. Additionally, the working oil in the arm rod side chamber 14 of the arm cylinder 10 may be introduced into a second load port 316B of the second control valve 310 through the arm rod hydraulic line 214, and be drained to the drain tank T through a second load passage 315B, a return passage 317, a tank passage 403 and a first tank port 318B.

The working oil from the arm rod side chamber 14 of the arm cylinder 10 may be drained to the drain tank T through the first return hydraulic line 222 via the second control valve 310. The pressure compensated valve 400 may be installed in the first return hydraulic line 222. The pressure compensated valve 400 may include the first pressure receiving portion 401A and the second pressure receiving portion 401B in both sides of a compensation spool 402.

The first pressure receiving portion 401A may be in communication with the first pilot line 410 branched off from the second load passage 315B of the second control valve 310 to receive a pressure of the working oil flowing through the arm rod hydraulic line 214 in front of the second control valve 310 as the first pilot pressure. In this case, the arm load hydraulic line 212 may include a flow path extending from the second load port 316B to the second load passage 315B.

The second pressure receiving part 401B may be in communication with the second pilot line 412 branched off from the return passage 317 selectively communicated with the first tank port 318B of the second control valve 310 to receive a pressure of the working oil flowing through the first return hydraulic line 222 in rear of the second control valve 310 as the second pilot pressure. In this case, the first return hydraulic line 222 may include a flow path extending from the first tank port 318B of the second control valve 310 to the return passage 317 through the tank passage 403.

The second pilot line 412 in communication with the return passage 317 may be in communication with the second pressure receiving portion 401B as an inlet of the pressure compensated valve 400, and the tank passage 403 in communication with the first tank port 318B may be in communication with an outlet 405 of the pressure compensated valve 400. The flow rate of the working oil flowing from the inlet 401B to the outlet 405 of the pressure compensated valve 400 may be adjusted such that a force due to the difference between the first pilot pressure in the first pressure receiving unit 401A and the second pilot pressure in the second pressure receiving unit 401B is equal to a spring force of a compensation spring 406. The compensation spool 402 may be connected to the compensation spring 406 so that the pressure difference between the front end and the rear end of the control valve may be compensated by the spring force of the compensation spring 406.

Accordingly, in the third position C of the second control valve 310, the working oil in the arm rod side chamber 14 of the arm cylinder 10 may be introduced into the second load port 316B of the second control valve 310 through the arm rod hydraulic line 214, and be drained to the drain tank T through the second load passage 315B, the return passage 317, the pressure compensated valve 400, the tank passage 403 and the first tank port 318B.

The pressure compensated valve 400 may perform a meter-out speed control so as to provide an appropriate back pressure under a load condition as well as a no load condition during arm crowd operation at the third position (C) of the second control valve 310, to thereby reduce pressure loss and back pressure and save energy.

Therefore, it may be possible to very easily solve a difficult tuning problem, which is a problem caused by an application of an existing regenerative cut valve, to thereby achieve a desired arm crowd control performance. Moreover, even if there is a change in weight of a bucket (load loading, heavy bucket, etc.), there is an advantage that tuning of an area diagram of an arm control spool becomes unnecessary.

The control system of the construction machine has been described with respect to the case of controlling the arm control valve during the arm crowd operation operated by its own weight, but it will be appreciated that the present invention is not limited thereto.

The present invention has been explained with reference to preferable embodiments, however, those skilled in the art may understand that the present invention may be modified or changed without being deviated from the concept and the scope of the present invention disclosed in the following claims.

<The description of the reference numerals>

| | |
|---|---|
| 10: hydraulic cylinder, arm cylinder | 12: arm head side chamber |
| 14: arm rod side chamber | 100: hydraulic pump |
| 200: main hydraulic line | 210: parallel line |
| 212: arm head hydraulic line | 214: arm rod hydraulic line |
| 222: first return hydraulic line | 224: second return hydraulic line |
| 300: first control valve | 310: control valve, second control valve |
| 311: valve body | 313: supply port |
| 314A: first branch passage | 314B: second branch passage |
| 315A: first load passage | 315B: second load passage |
| 316A: first load port | 316B: second load port |
| 317: return passage | 318B: first tank port |

-continued

<The description of the reference numerals>

| | |
|---|---|
| 400: pressure compensated valve | 410A: first pressure receiving portion |
| 410B: second pressure receiving portion | 402: compensation spool |
| 403: tank passage | 405: outlet |
| 406: compensation spring | 410: first pilot line |
| 412: second pilot line | |

The invention claimed is:

1. A control system for construction machinery, comprising:

a hydraulic cylinder operable by a working oil discharged from a hydraulic pump;

a control valve arranged between the hydraulic pump and the hydraulic cylinder to control an operation of the hydraulic cylinder according to a position of a spool therein, the control valve having a first spool position for draining the working oil discharged from a chamber of the hydraulic cylinder to a drain tank; and a pressure compensated valve installed in a return hydraulic line through which the working oil discharged from the control valve at the first spool position is drained to the drain tank, the pressure compensated valve being configured to control a flow rate of the working oil passing through the pressure compensated valve according to a pressure difference between a front end and a rear end of the control valve, wherein an opening amount of the pressure compensated valve is controlled according to a pressure difference between a first pilot pressure supplied through a first pilot line branched off from a rod hydraulic line connected to the chamber and a second pilot pressure supplied through a second pilot line branched off from the return hydraulic line in front of the pressure compensated valve.

2. The control system for construction machinery of claim 1, wherein the chamber is a rod side chamber of the hydraulic chamber cylinder.

3. The control system for construction machinery of claim 1, wherein the hydraulic cylinder includes an arm cylinder.

4. The control system for construction machinery of claim 1, wherein a valve body of the pressure compensated valve is formed in a valve body of the control valve or in another valve body separate from the valve body of the control valve.

5. The control system for construction machinery of claim 1, wherein the pressure compensated valve includes a compensation spring that is connected to a compensation spool and is configured to compensate the pressure difference between the front end and the rear end of the control valve by a spring force.

6. The control system for construction machinery of claim 1, wherein the working oil is drained to the drain tank through a return passage, a tank passage and a tank port that are selectively in communication with each other by a valve spool of the control valve, and the return passage, the tank passage and the tank port constitute at least a portion of the return hydraulic line, and wherein an inlet of the pressure compensated valve is in communication with the second pilot line that is in communication with the return passage and an outlet of the pressure compensated valve is in communication with the tank passage.

7. The control system for construction machinery of claim 1, wherein an opening amount of the pressure compensated valve is configured to be controlled such that a difference between the first pilot pressure and the second pilot pressure becomes a constant value.

8. A control system for construction machinery, comprising:

a hydraulic cylinder operable by a working oil discharged from a hydraulic pump;

a control valve arranged between the hydraulic pump and the hydraulic cylinder to control an operation of the hydraulic cylinder according to a position of a spool therein, the control valve having a first spool position for draining the working oil discharged from a rod side chamber of the hydraulic cylinder to a drain tank; and a pressure compensated valve installed in a return hydraulic line through which the working oil discharged from the control valve at the first spool position is drained to the drain tank, the pressure compensated valve being configured to control a flow rate of the working oil passing through the pressure compensated valve according to a pressure difference between a front end and a rear end of the control valve, wherein an opening amount of the pressure compensated valve is controlled according to a pressure difference between a first pilot pressure supplied through a first pilot line branched off from a rod hydraulic line connected to the rod side chamber and a second pilot pressure supplied through a second pilot line branched off from the return hydraulic line in front of the pressure compensated valve, wherein the pressure compensated valve includes a compensation spring that is connected to a compensation spool and is configured to compensate the pressure difference between the front end and the rear end of the control valve by a spring force, wherein the working oil is drained to the drain tank through a return passage, a tank passage and a tank port that are selectively in communication with each other by a valve spool of the control valve, and the return passage, the tank passage and the tank port constitute at least a portion of the return hydraulic line, and wherein an inlet of the pressure compensated valve is in communication with a second pilot line that is in communication with the return passage and an outlet of the pressure compensated valve is in communication with the tank passage.

* * * * *